US010087791B2

(12) United States Patent
Kobayashi et al.

(10) Patent No.: US 10,087,791 B2
(45) Date of Patent: Oct. 2, 2018

(54) VALVE OPENING/CLOSING TIMING CONTROL APPARATUS

(71) Applicant: AISIN SEIKI KABUSHIKI KAISHA, Kariya-shi, Aichi-ken (JP)

(72) Inventors: Masaki Kobayashi, Okazaki (JP); Shohei Masuda, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 119 days.

(21) Appl. No.: 15/372,441

(22) Filed: Dec. 8, 2016

(65) Prior Publication Data

US 2017/0159511 A1 Jun. 8, 2017

(30) Foreign Application Priority Data

Dec. 8, 2015 (JP) ..... 2015-239341

(51) Int. Cl.
*F01L 1/34* (2006.01)
*F01L 1/344* (2006.01)
*F02D 13/02* (2006.01)

(52) U.S. Cl.
CPC ..... *F01L 1/3442* (2013.01); *F02D 13/0219* (2013.01); *F01L 2001/34423* (2013.01); *F01L 2001/34466* (2013.01)

(58) Field of Classification Search
CPC ..... F01L 1/3442; F01L 2001/34466; F01L 2001/34423; F02D 13/0219
See application file for complete search history.

(56) References Cited

U.S. PATENT DOCUMENTS 6,439,181 B1 * 8/2002 Fujiwaki ..... F01L 1/3442 123/90.17
6,976,460 B2 12/2005 Komazawa et al.

FOREIGN PATENT DOCUMENTS

JP 2004-257313 A 9/2004

* cited by examiner

*Primary Examiner* — Zelalem Eshete
(74) *Attorney, Agent, or Firm* — Buchanan Ingersoll & Rooney PC

(57) ABSTRACT

A valve opening/closing timing control apparatus includes: a driving side rotational body synchronously rotating with a crankshaft of an internal combustion engine; a driven side rotational body arranged in the driving side rotational body to share a rotational axis therewith and integrally rotating with a camshaft; advanced angle and retarded angle chambers defined between the driving side and driven side rotational bodies; a lock mechanism maintaining a relative rotational phase between the driving side and driven side rotational bodies by separately biasing first and second lock members to be engaged with first and second recesses; and a fluid controller releasing the locked state by supplying a hydraulic fluid to the first and second recesses, and controlling the relative rotational phase by supplying and discharging the hydraulic fluid to the advanced angle and retarded angle chambers.

9 Claims, 6 Drawing Sheets

VALVE OPENING/CLOSING TIMING CONTROL APPARATUS

CROSS REFERENCE TO RELATED APPLICATIONS

This application is based on and claims priority under 35 U.S.C. § 119 to Japanese Patent Application 2015-239341, filed on Dec. 8, 2015, the entire contents of which are incorporated herein by reference.

TECHNICAL FIELD

This disclosure relates to a technique that includes a driving side rotational body that synchronously rotates with a crankshaft and a driven side rotational body that integrally rotates with a camshaft for valve opening/closing, and controls a lock mechanism that restricts a relative rotational phase of the rotating bodies.

BACKGROUND DISCUSSION

As a valve opening/closing timing control apparatus configured as described above, JP 2004-257313A (Reference 1) discloses a technique in which a driven side rotational body is included in a driving side rotational body, and a lock member configured to be engaged to or disengaged from a lock recess formed in the driven side rotational body is supported to freely protrude from or retreat into the driving side rotational body in a radial direction, and biased in a protrusion direction by a spring.

In Reference 1, a pair of lock members and a pair of lock recesses respectively corresponding to the respective lock members are formed, and a stepped portion is formed in at least one of the lock recesses. The reason why the stepped portion is formed is that when shifting to a locked state, one of the lock members, which corresponds to the stepped portion, is engaged with the stepped portion to reduce a region in which a relative rotational phase fluctuates, and to facilitate the fitting of the other lock member into the lock recess.

Providing a pair of lock members as described in Reference 1 is to facilitate the shifting to the locked state as compared with providing a single lock member.

However, when the lock members are supported to freely protrude from or retreat into the driving side rotational body, and the lock recesses to be engaged with the lock members are formed in the driven side rotational body as described in Reference 1, a large force may act on the lock members in the shear direction due to a rotation force transmitted from the driving side rotational body to the driven side rotational body, or a cam fluctuating torque during the operation of the engine. Thus, in some cases, a rapid lock release may not be carried out even though hydraulic oil is supplied to the lock recesses.

In order to solve the problem, the lock release has been carried out in a state where the action of the shear force is suppressed by supplying the hydraulic oil to an advanced angle chamber or a retarded angle chamber. That is, in order to suppress the shear force acting on one lock member, the lock of the one lock member is released by supplying the hydraulic oil to one of the advanced angle chamber and the retarded angle chamber. Then, in order to suppress the shear force acting on the other lock member, the lock of the other lock member is released by supplying the hydraulic oil to the remaining one of the advanced angle chamber and the retarded angle chamber.

However, in such a control mode, time is required not only for the control of the valve, but also until the hydraulic pressure acts in a direction that changes the relative rotational phase. As a result, time is required to release the locked state.

SUMMARY

Thus, a need exists for a valve opening/closing timing control apparatus which is not suspectable to the drawback mentioned above.

An aspect of this disclosure is directed to a valve opening/closing timing control apparatus including: a driving side rotational body configured to synchronously rotate with a crankshaft of an internal combustion engine; a driven side rotational body arranged in the driving side rotational body to share a rotational axis therewith and configured to integrally rotate with a camshaft for valve opening/closing of the internal combustion engine; an advanced angle chamber and a retarded angle chamber defined between the driving side rotational body and the driven side rotational body; a lock mechanism configured to maintain a relative rotational phase between both the rotational bodies by separately biasing a first lock member and a second lock member supported by the driving side rotational body to be respectively engaged with a first recess and a second recess formed in the driven side rotational body; and a fluid controller configured to release the locked state by supplying a hydraulic fluid to the first recess and the second recess such that the first lock member and the second lock member are disengaged from the first recess and the second recess, and to control the relative rotational phase by supplying and discharging the hydraulic fluid with respect to the advanced angle chamber and the retarded angle chamber. As a rotational frequency of the driving side rotational body to bring the first and second lock members into a lock released state by a centrifugal force, a first release rotational frequency of the first lock member is set to be lower than a second release rotational frequency of the second lock member. The fluid controller controls the relative rotational phase to be a phase at which the first recess does not exert a shear force on the first lock member when lock release.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments disclosed here will be described with reference to the drawings.

[Basic Configuration]

Figure 1:
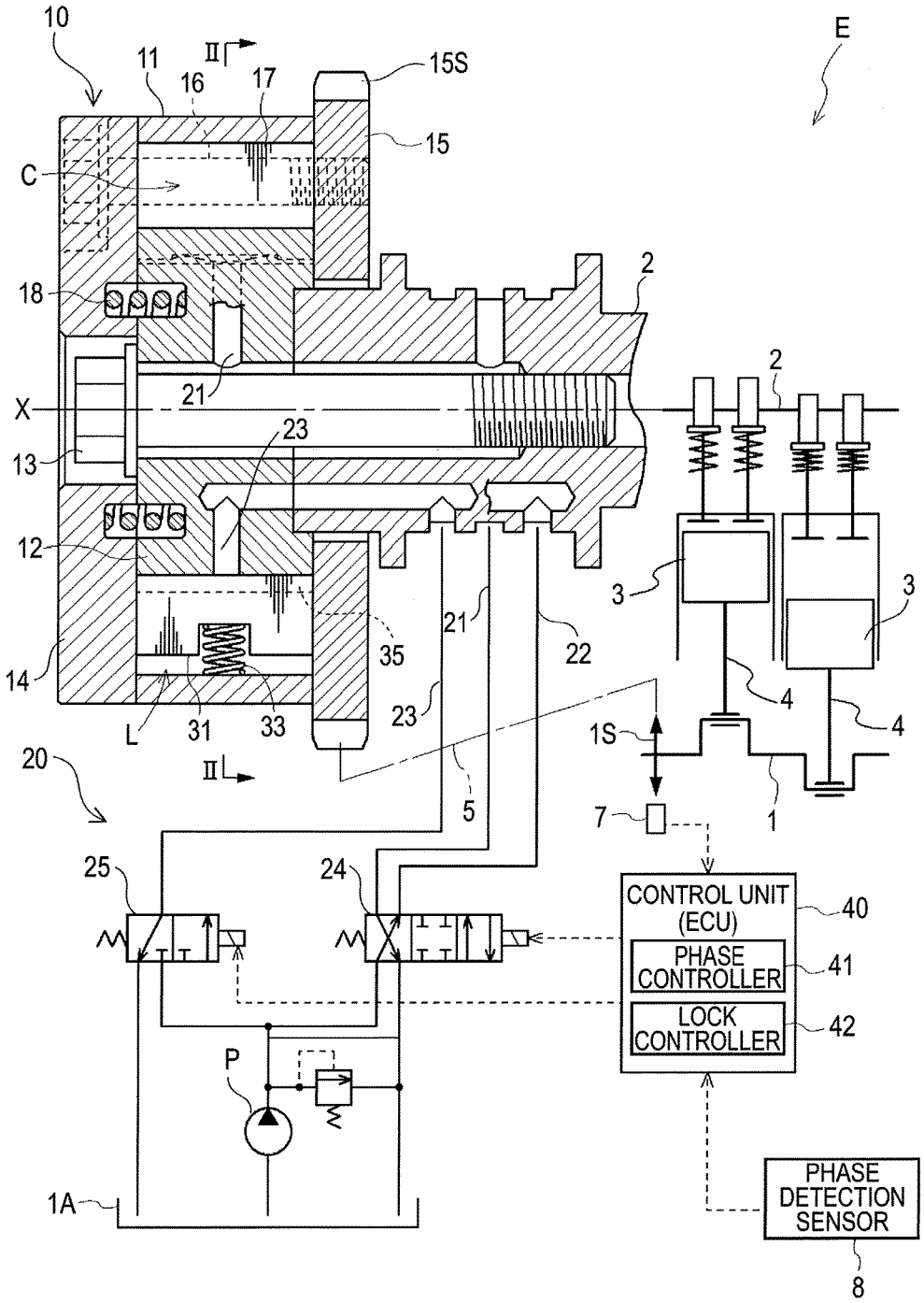
FIG. 1 is a view illustrating a configuration of a valve opening/closing timing control apparatus.
Figure 2:
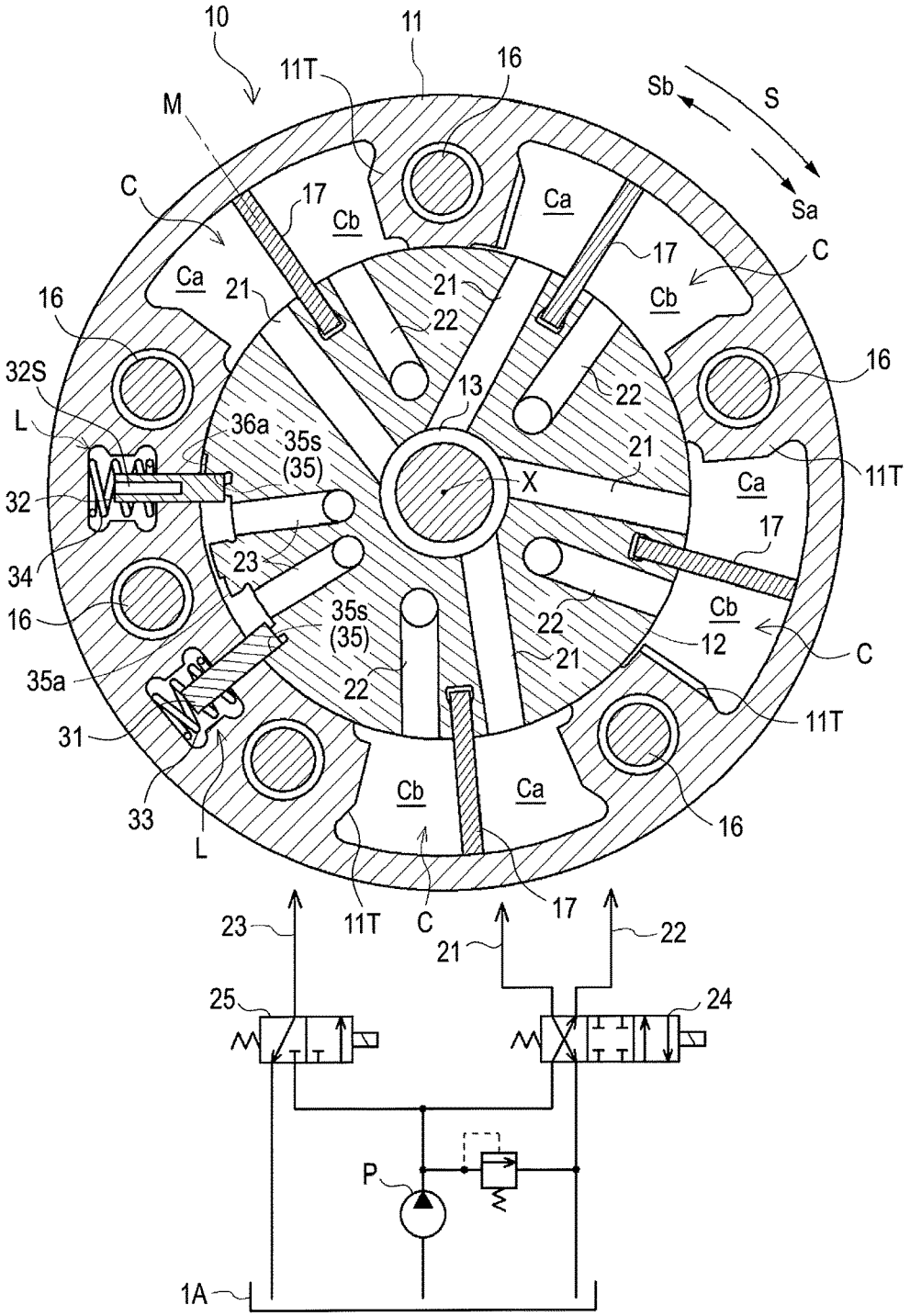
FIG. 2 is a cross-sectional view taken II-II line, illustrating a locked state in an intermediate lock phase.

As illustrated in FIGS. 1 and 2, a valve opening/closing timing control apparatus includes a valve opening/closing timing controller 10 that sets an opening/closing timing of an intake valve of an engine E as an internal combustion engine, a hydraulic oil controller 20 (an exemplary fluid controller) that controls a hydraulic oil (an exemplary hydraulic fluid) for the valve opening/closing timing controller 10, and a control unit (ECU) 40 that controls the hydraulic oil controller 20.

It is assumed that the engine E is provided in a vehicle such as a passenger car, and the hydraulic oil (hydraulic fluid) from a hydraulic pump P driven by the engine E is supplied to the hydraulic controller 20 (the fluid controller). The hydraulic controller 20 includes a phase control valve 24 (OCV) configured with an electromagnetic valve and a lock control valve 25 (OSV) configured with an electromagnetic valve.

The phase control valve 24 realizes a control of a relative rotational phase between an outer rotor 11 (an exemplary driving side rotational body) and an inner rotor 12 (an exemplary driven side rotational body) of the valve opening/closing timing controller 10 (hereinafter, referred to as a "relative rotational phase"). Further, the lock control valve 25 realizes a control of a lock mechanism L of the valve opening/closing timing controller 10.

The control unit 40 enables the control of the phase control valve 24 and the lock control valve 25 by acquiring detection signals from a rotational frequency sensor 7 that detects a rotational frequency (revolutions per unit time) of a crankshaft 1 and a phase detection sensor 8 that detects a relative rotational phase (this control mode will be described later).

[Valve Opening/Closing Timing Controller]

The valve opening/closing timing controller 10 includes an outer rotor 11 (a driving side rotational body) synchronously rotating with the crankshaft 1 of the engine E, and an inner rotor 12 (a driven side rotational body) connected to an intake camshaft 2, which opens/closes an intake valve of a combustion chamber of the engine E, by a connecting bolt 13.

The engine E is configured in a four-cycle type in which pistons 3 are accommodated in a plurality of cylinder bores in a cylinder block, and the pistons 3 are connected to the crankshaft 1 via connecting rods 4, respectively.

The intake camshaft 2 is supported to be rotatable about a rotational axis X with respect to the engine E. In the valve opening/closing timing controller 10, the inner rotor 12 is included in the outer rotor 11, and the axis of the outer rotor 11 and the axis of the inner rotor 12 are disposed coaxially with the rotational axis X so as to be rotatable relative to each other about the rotational axis X.

The outer rotor 11 has a configuration in which a front plate 14 and a rear plate 15 are fastened by fastening bolts 16, and the inner rotor 12 is disposed (included) at a position to be sandwiched between the front plate 14 and the rear plate 15.

The inner rotor 12 has an opening formed coaxially with the rotational axis X, and the inner rotor 12 is connected to the intake camshaft 2 by the connecting bolt 13 that is inserted through the opening. A timing sprocket 15S is formed on the outer periphery of the rear plate 15.

The outer rotor 11 synchronously rotates with the crankshaft 1 by wrapping a timing chain 5 around the timing sprocket 15S and an output sprocket 1S provided on the crankshaft 1 of the engine E. Although not illustrated in the drawings, an apparatus having the same configuration as that of the valve opening/closing timing controller 10 is also provided at the front end of the exhaust-side camshaft, and a rotational force is also transmitted to the apparatus from the timing chain 5.

As illustrated in FIG. 2, a plurality of protruding walls 11T protruding radially inwardly are formed integrally with the outer rotor 11. The inner rotor 12 is formed in a cylindrical shape having an outer periphery that is in close contact with the protruding ends of the plurality of protruding walls 11T, and includes a plurality of vanes 17 protruding outwardly on the outer peripheral portion of the inner rotor 12.

From this configuration, in a state where the inner rotor 12 is included in the outer rotor 11, a fluid pressure chamber C is formed between the protruding walls 11T that are adjacent to each other in the rotational direction on the outer side of the inner rotor 12. The fluid pressure chamber C is partitioned by a vane 17 so as to form an advanced angle chamber Ca and a retarded angle chamber Cb that are partitioned from each other.

As illustrated in FIG. 2, in the valve opening/closing timing controller 10, the outer rotor 11 rotates in a drive rotation direction S by a driving force from the crankshaft 1. In addition, a direction where the inner rotor 12 rotates in the same direction as the drive rotation direction S with respect to the outer rotor 11 is referred to as an "advanced angle direction Sa," and a rotational direction in the reverse direction is referred to as a "retarded angle direction Sb." An operation end of the retarded angle direction Sb in the relative rotational phase between the outer rotor 11 and the inner rotor 12 is referred to as a "most retarded angle phase," and an operation end of the advanced angle direction Sa in the relative rotational phase is referred to as a "most advanced angle phase."

In the valve opening/closing timing controller 10, when the hydraulic oil is supplied to the advanced angle chamber Ca, the relative rotational phase is displaced in the advanced angle direction Sa. Thus, the intake compression ratio of the engine E increases. On the contrary, when the hydraulic oil is supplied to the retarded angle chamber Cb, the relative rotational phase is displaced in the retarded angle direction Sb. Thus, the relationship between the crankshaft 1 and the intake camshaft 2 is set such that the intake compression ratio of the engine E decreases.

As illustrated in FIG. 1, a torsion spring 18 is provided over the inner rotor 12 and the front plate 14 to apply a biasing force until the relative rotational phase of the outer rotor 11 and the inner rotor 12 reaches an intermediate lock phase M (see FIG. 2) from the most retarded angle phase. The range in which the biasing force of the torsion spring 18 is applied may exceed the intermediate lock phase M or may not reach the intermediate lock phase M.

The inner rotor 12 includes an advanced angle control oil passage 21 that communicates with the advanced angle chamber Ca, a retarded angle control oil passage 22 that communicates with the retarded angle chamber Cb, and a lock release oil passage 23 that communicates with two lock recesses to be described below (i.e., a first lock recess 35 and a second lock recess 36). Further, in the valve opening/closing timing control apparatus, a lubricating oil stored in an oil pan 1A of the engine E is used as a hydraulic oil.

[Valve Opening/Closing Timing Controller: Lock Mechanism]

The lock mechanism L of the valve opening/closing timing controller 10 is configured to be shifted to the locked state when the hydraulic oil is not supplied to the lock release oil passage 23, and to release the locked state when the hydraulic oil is supplied to the lock release oil passage 23. A relative rotational phase which becomes the operation end of the advanced angle direction Sa is referred to as the "most advanced angle phase," and a relative rotational phase which becomes the operation end of the retarded angle direction Sb is referred to as the "most retarded angle phase." The intermediate lock phase M is a phase which is set between the most advanced angle phase and the most retarded angle phase and realizes a good start of the engine E in a low temperature state.

Figure 3:
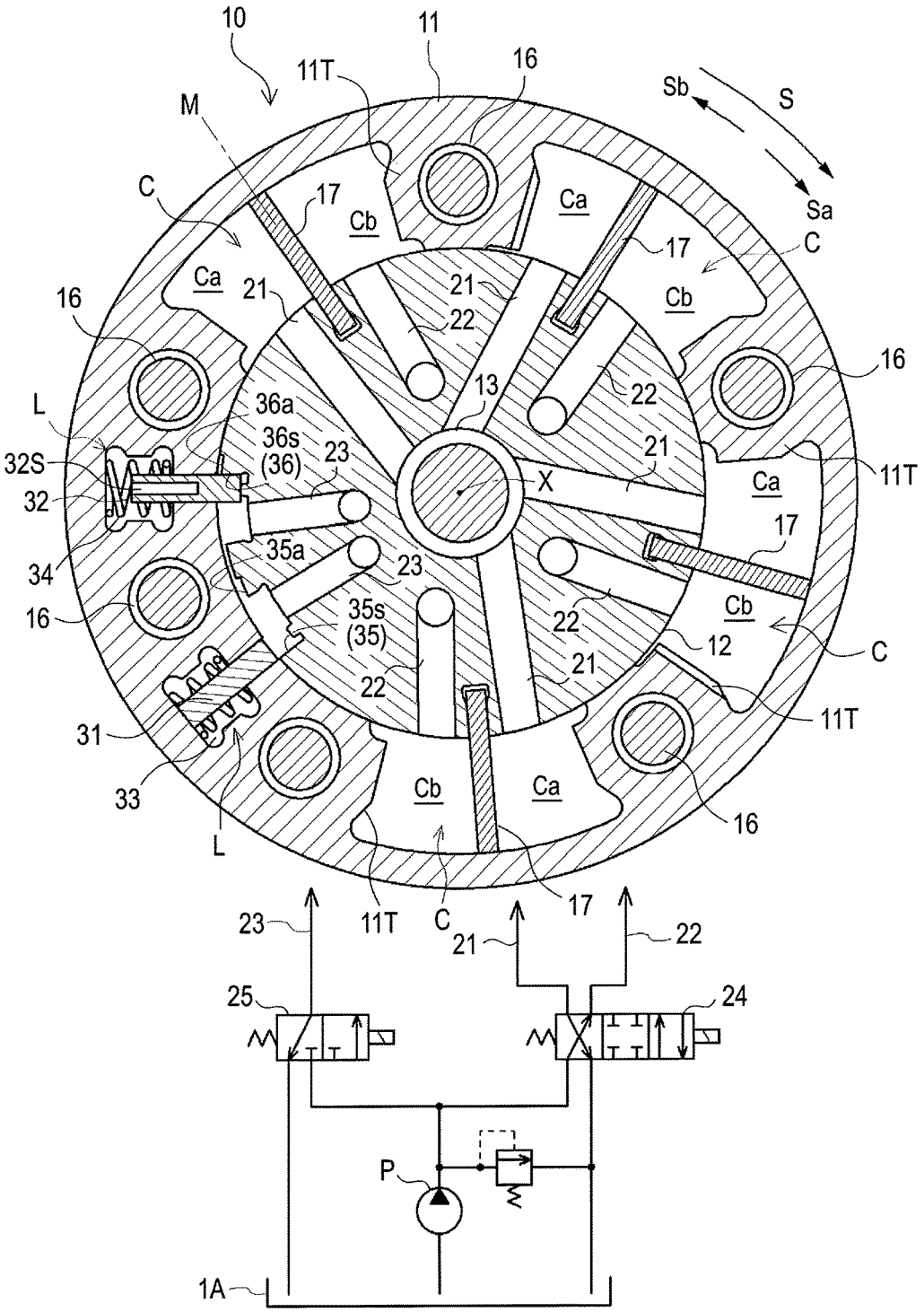
FIG. 3 is a cross-sectional view illustrating a state where the locked state of the first lock member is released.
Figure 4:
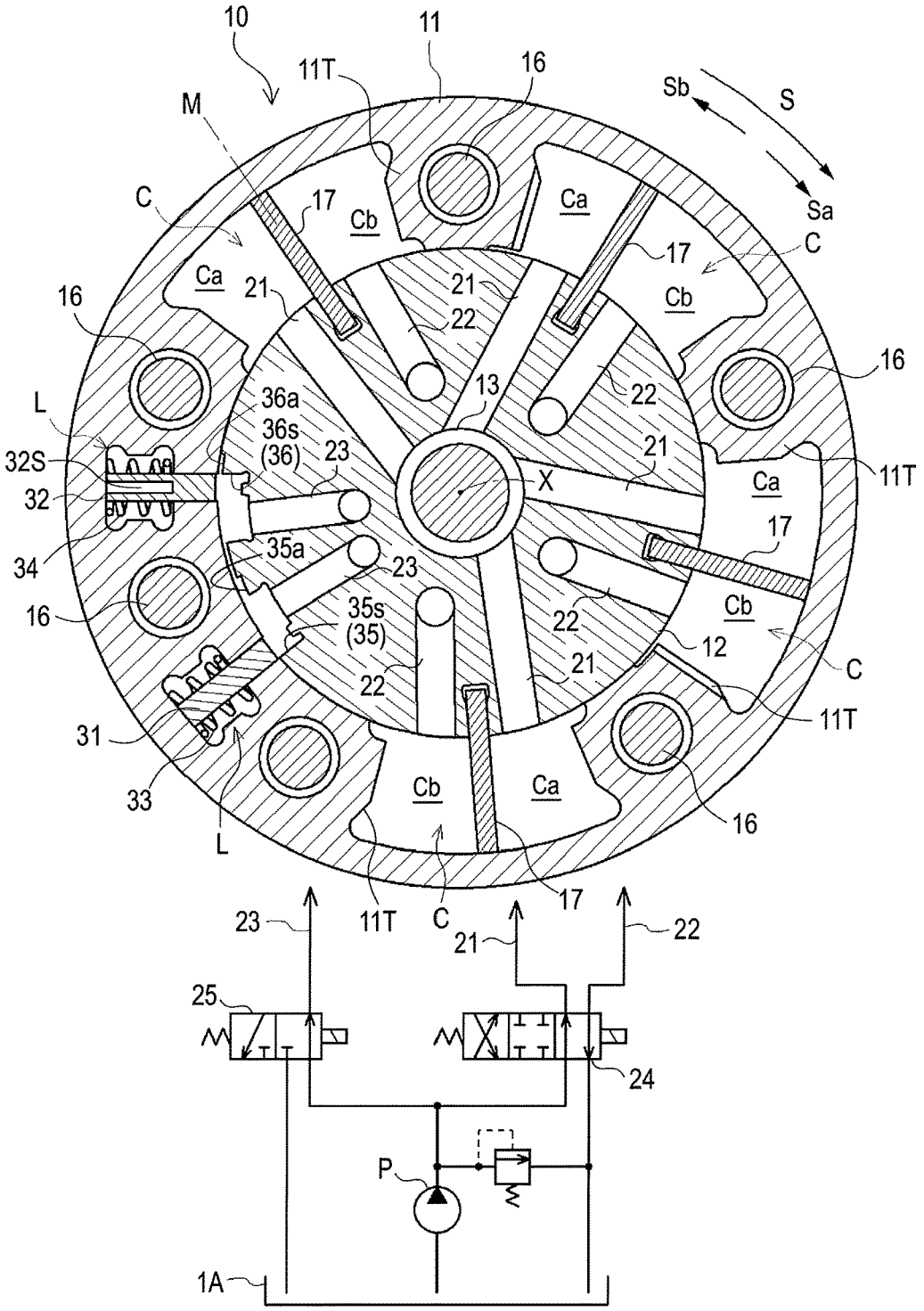
FIG. 4 is a cross-sectional view illustrating a state where the locked state of the first lock member and the second lock member is released.

As illustrated in FIGS. 2 to 4, the lock mechanism L includes a first lock member 31 and a second lock member 32 that are supported to freely protrude from and retreat in the radial inside with respect to the outer rotor 11, and a first spring 33 and a second spring 34 that bias the lock members to protrude. Further, the lock mechanism L includes a first lock recess 35 (an exemplary first recess) formed on the outer periphery of the inner rotor 12 to be engaged with the first lock member 31, and similarly, a second lock recess 36 (an exemplary second recess) formed on the outer periphery of the inner rotor 12 to be engaged with the second lock member 32.

The first lock member 31 and the second lock member 32 are disposed at a predetermined interval in a circumferential direction with respect to the outer rotor 11, and supported to be slidable with respect to a slit formed in the outer rotor 11 such that the first lock member 31 and the second lock member 32 are capable of performing an operation of approaching the rotational axis X and an operation of separating from the rotational axis X. A plate type member is used for the lock members.

Particularly, in this configuration, in order to set the mass of the first lock member 31 to be larger than the mass of the second lock member 32, a hollow portion 32S is formed in a part of the inside of the second lock member 32, and the first spring 33 and the second spring 34, which apply the same biasing force, are used here. Alternatively, in order to set the mass of the first lock member 31 to be larger than the mass of the second lock member 32, materials having different specific gravities may be used.

Therefore, when the rotational frequency (revolutions per unit time; rotational speed) of the valve opening/closing timing controller 10 exceeds a predetermined first release rotational frequency, the first lock member 31 may be disengaged from the first lock recess 35 and moved to a lock release position by a centrifugal force. For example, the first release rotational frequency is set to be higher than a rotational frequency during the idling of the engine E. In addition, when the rotational frequency of the valve opening/closing timing controller 10 exceeds a second release rotational frequency that is higher than the first release rotational frequency, the second lock member 32 may be disengaged from the second lock recess 36 and moved to the lock release position by a centrifugal force.

In this configuration, the second release rotational frequency is set. However, when the locked state of the lock mechanism L is released, a control is performed to disengage the second lock member 32 from the second lock recess 36 by supplying the hydraulic oil to the second lock recess 36 before the rotational frequency of the valve opening/closing timing controller 10 reaches the second release rotational frequency, as will be described below.

As illustrated in FIG. 2, the first lock recess 35 and the second lock recess 36 are formed in a groove shape which is wider than the thickness of the corresponding lock member (wider in the circumferential direction of the inner rotor 12) and in parallel with the rotational axis X. In addition, a first stepped portion 35*a* and a second stepped portion 36*b* are formed in a shallow groove shape at the downstream side of the drive rotation direction S in the opening portions of the first lock recess 35 and the second lock recess 36, respectively. Each of the stepped portions functions as a ratchet to assist fitting the lock member into the lock recess by temporarily engaging with the lock member before the lock member is fitted into the lock recess, thereby reducing the relative displacement between the outer rotor 11 and the inner rotor 12 (relative rocking around the rotational axis X).

In addition, when the lock mechanism L is in the locked state, as illustrated in FIG. 2, the protruding end of the first lock member 31 is brought into contact with the bottom wall of the first lock recess 35 by the biasing force of the first spring 33 (contact in a state of slightly floating by a small protrusion on the bottom wall), and is also brought into contact with a first inner wall surface 35*s* at the upstream side of the drive rotation direction S in the circumferential direction, among the inner wall surfaces of the first lock recess 35. Further, the protruding end of the second lock member 32 is brought into contact with the bottom wall of the second lock recess 36 by the biasing force of the second spring 34 (contact in a state of slightly floating by a small protrusion on the bottom wall), and is also brought into contact with a second inner wall surface 36*s* at the downstream side of the drive rotation direction S in the circumferential direction, among the inner wall surfaces of the second lock recess 36. Accordingly, the relative rotational phase is maintained in a state of suppressing a phenomenon in which the relative rotational phase slightly fluctuates (rattling).

[Fluid Control Mechanism of Valve Opening/Closing Timing Control Apparatus]

The phase control valve 24 is configured such that a spool is capable of being subjected to a switching operation among three positions (i.e., an advanced angle position, a retarded angle position, and a neutral position) by electric power (a control signal) supplied to the electromagnetic solenoid.

In the phase control valve 24, the spool is held at the retarded angle position in a state where no electric power is supplied to the electromagnetic solenoid (duty ratio of 0%), the spool is operated to the advanced angle position by supplying the maximum electric power to the electromagnetic solenoid (duty ratio of 100%), and the spool is operated to the neutral position by supplying electric power at a duty ratio of about 50%.

With the configuration of the phase control valve 24, when no electric power is supplied to the electromagnetic solenoid of the phase control valve 24 by the control of the control unit 40, the hydraulic oil is supplied from the hydraulic pump P to the retarded angle chamber Cb through the retarded angle control oil passage 22, and the hydraulic oil in the advanced angle chamber Ca is discharged from the advanced angle control oil passage 21.

On the contrary, in a case where the maximum electric power is supplied to the electromagnetic solenoid of the phase control valve 24, the hydraulic oil is supplied from the hydraulic pump P to the advanced angle chamber Ca through the advanced angle control oil passage 21, and the hydraulic oil in the retarded angle chamber Cb is discharged from the retarded angle control oil passage 22. Further, when the spool of the phase control valve 24 is set to the neutral position, the hydraulic oil is neither supplied to nor discharged from both of the advanced angle chamber Ca and the retarded angle chamber Cb, and the relative rotational phase is maintained.

In the lock control valve 25, the spool is held at a lock position in a state where no electric power is supplied to the electromagnetic solenoid (duty ratio of 0%), and the spool is brought to an unlock position by supplying the maximum electric power to the electromagnetic solenoid (duty ratio of 100%).

With the configuration of the lock control valve 25, when no electric power is supplied to the electromagnetic solenoid, the spool is held at the lock position, and the hydraulic oil is not supplied to the lock release oil passage 23. On the contrary, when electric power is supplied to the electromagnetic solenoid, the spool is operated to the unlock position, and the hydraulic oil is supplied to the lock release oil passage 23.

[Control Configuration and Control Mode]

As illustrated in FIG. 1, the control unit 40 is configured such that signals from the rotational frequency sensor 7 and the phase detection sensor 8 are input to the control unit 40 and the control unit 40 outputs a control signal to the phase control valve 24 (OCV) and the lock control valve 25 (OSV).

The control unit 40 includes a phase controller 41 and a lock controller 42. While the controllers are configured with software, each of the controllers may be partially or entirely configured with hardware such as a logic circuit.

The phase controller 41 performs a control of displacing the relative rotational phase to a target phase in the form of feeding back a signal from the phase detection sensor 8 by controlling the phase control valve 24 in a state where the spool of the lock control valve 25 is held at the unlock position. In addition, the lock controller 42 performs a control of shifting the lock mechanism L to the locked state and a control of releasing the locked state by controlling the phase control valve 24 and the lock control valve 25.

At the time of stopping the engine E, the lock controller 42 performs a control of shifting the lock mechanism L to the locked state before the engine E is completely stopped. Therefore, the lock mechanism L is in the locked state at the time of starting the engine E.

Since the lock mechanism L is in the locked state in this manner, even when a fluctuating torque acts from the intake camshaft 2 in a state where no hydraulic oil is supplied from the hydraulic pump P at the time of starting the engine E, the lock mechanism L suppresses fluctuation in relative rotational phase between the outer rotor 11 and the inner rotor 12, thereby suppressing the fluctuation of the intake timing and the occurrence of abnormal noise.

Particularly, in the valve opening/closing timing control apparatus, the release of the locked state of the first lock member 31 is allowed by a centrifugal force at a time point where the rotational frequency of the valve opening/closing timing controller 10 exceeds the first release rotational frequency after starting the engine E. Thereafter, the control mode is set such that the lock controller 42 controls the lock control valve 25 to supply the hydraulic oil to the lock release oil passage 23, thereby releasing the locked state of the second lock member 32. Hereinafter, descriptions will be made on a control of realizing the release of the locked state of the lock mechanism L.

At a time point where the engine E is stopped, the lock mechanism L is in the locked state where the first lock member 31 is engaged with the first lock recess 35 and the second lock member 32 is engaged with the second lock recess 36, as illustrated in FIG. 2. Further, as illustrated as the timing of T0 in FIG. 5, the spool of the phase control valve 24 is at the retarded angle position, and the spool of the lock control valve 25 is at the lock position.

Figure 5:
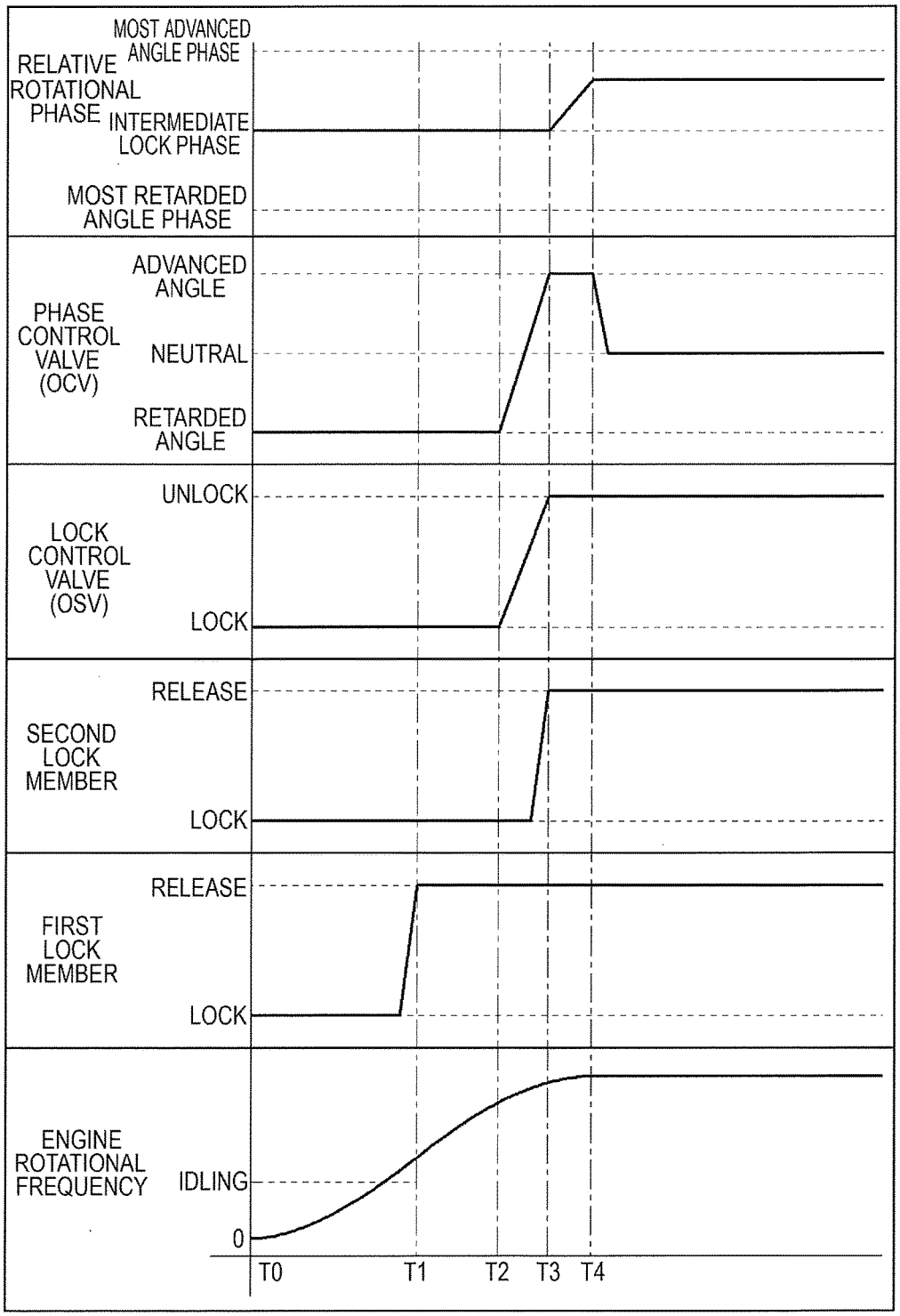
FIG. 5 is a timing chart illustrating an operation at the time of lock release.
Figure 6:
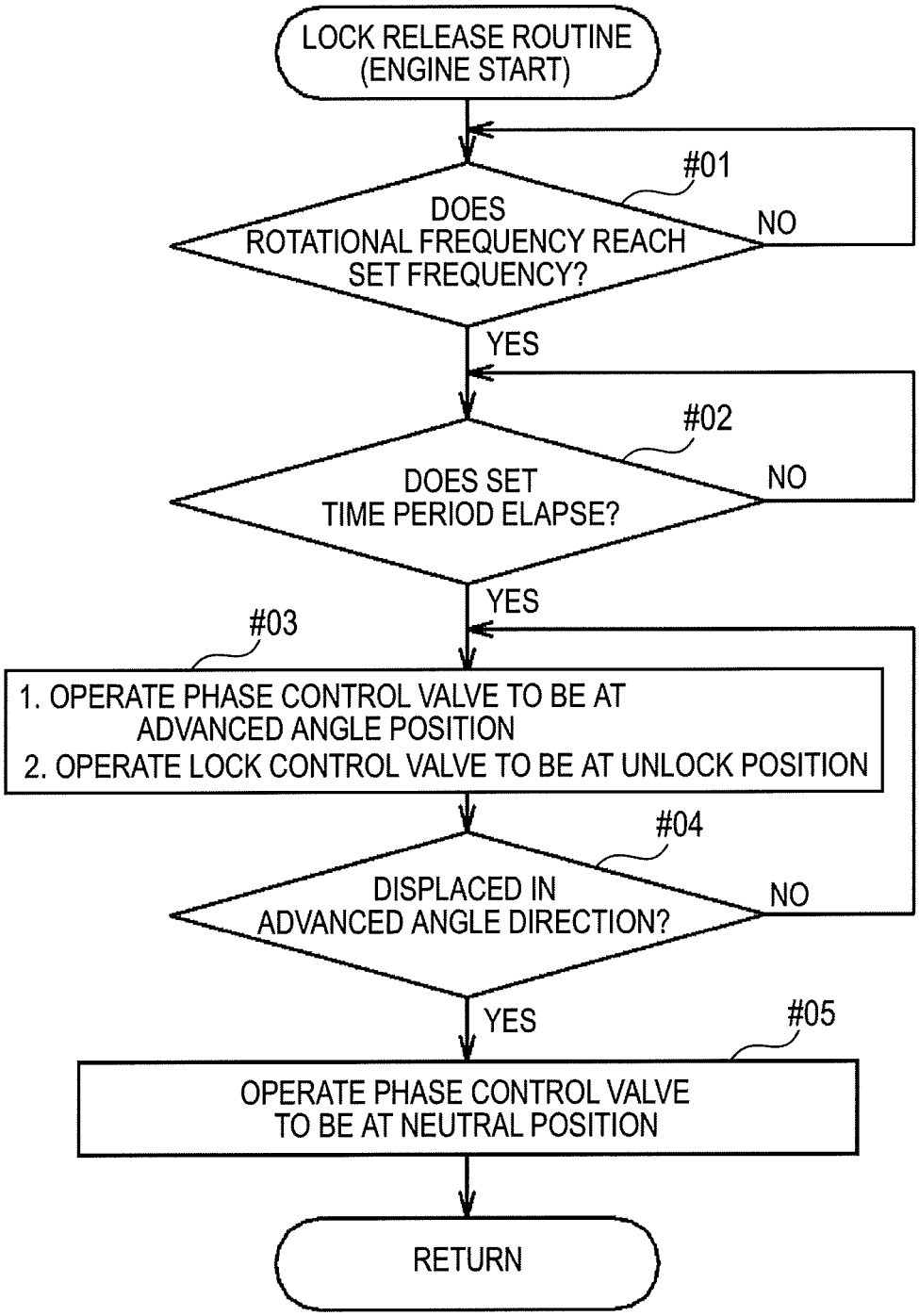
FIG. 6 is a flowchart of a lock release routine.

When the engine E is started in such a state, a control is performed in accordance with the flowchart illustrated as a lock release routine in FIG. 6, so that respective parts are operated as illustrated in the timing chart of FIG. 5.

Specifically, when the rotational frequency of the valve opening/closing timing controller 10 increases by starting the engine E and, for example, stepping down the accelerator pedal, the hydraulic pressure of the hydraulic oil ejected from the hydraulic pump P also increases.

Here, considering the situation at the time of operating the engine, in the lock mechanism L, a shear force acts on a gap between the first lock member 31 and a first inner wall surface 35*s* of the first lock recess 35, or a gap between the second lock member 32 and a second inner wall surface 36*s* of the second lock recess 36. For this reason, it is difficult that the rapid lock release is hardly performed even though the hydraulic oil is supplied to the lock release oil passage 23.

On the contrary, when the engine E is started, the spool of the phase control valve 24 is at the retarded angle position. Thus, when the rotational frequency of the engine E increases, the flow rate of the hydraulic oil supplied to the retarded angle chamber Cb correspondingly increases, so that the hydraulic press increases as well. Therefore, in the valve opening/closing timing controller 10, a force acts in a direction of displacing the relative rotational phase in the retarded angle direction Sb (toward a phase not applying a shear force to the first lock member 31), so that the shear force acting between the first lock member 31 and the first lock recess 35 is eliminated. Further, when the force acts in this direction, the shear force increases in a gap between the second lock member 32 and the second inner wall surface 36*s*.

For this reason, when the rotational frequency of the outer rotor 11 reaches a predetermined value that is higher than a value corresponding to the idling rotational frequency, the first lock member 31 is disengaged from the first lock recess 35 by a centrifugal force, as illustrated in FIG. 3, at a timing of T1.

Further, in the lock release routine illustrated in FIG. 6, when it is determined that the rotational frequency detected by the rotational frequency sensor 7 reaches a set value that is equal to or higher than the first release rotational frequency, it may be determined that the first lock member 31 is disengaged from the first lock recess 35 by a centrifugal force (step #01). Thus, a lapse of a set time is awaited (step #02).

At a timing of T2 when the set time has elapsed, the spool of the phase control valve 24 is set to be at the advanced angle position, and the spool of the lock control valve 25 is set to be at the unlock position (step #03). Here, for the rotational frequency at the timing of T2, the rotational frequency of the valve opening/closing controller 10 is set to be lower than the second release rotational frequency.

When such a control is performed, the shear force is suppressed from acting on the gap between the second lock member 32 and the second lock recess 36, and in the suppressed state, the second lock member 32 is disengaged from the second lock recess 36, as illustrated in FIG. 4, by the pressure of the hydraulic oil supplied to the second lock recess 36 at a timing of T3.

After the control, the locked state of the lock mechanism L is released, and the relative rotational phase starts to displace in the advanced angle direction Sa. The phase detection sensor 8 detects the displacement in the advanced angle direction, and then, at a timing of T4, the spool of the phase control valve 24 is operated to the neutral position, and the lock release routine is terminated (step #04).

In addition, when the relative rotational phase is to be displaced to a target phase after the lock release routine is terminated in this manner, the control unit 40 will operate the phase control valve 24 following the routine.

[Action and Effect of Embodiment]

That is, the lock mechanism L is configured with the first lock member 31 and the second lock member 32, and configured such that, as the outer rotor 11 exceeds the first release rotational frequency, the first lock member 31 is disengaged from the first lock recess 35 by the action of a centrifugal force. Further, when the engine E is stopped, the control mode is set such that the lock mechanism L is brought into the locked state before the engine E is completely stopped. Then, in the situation where the engine E is stopped, the spool of the phase control valve 24 is held at the retarded angle position, and the spool of the lock control valve 25 is held at the lock position.

Therefore, after the start of the engine E, the pressure of the hydraulic oil supplied to the retarded angle chamber Cb suppresses the shear force from acting on the gap between the protruding end of the first lock member 31 and the first inner surface 35*s* of the first lock recess 35. Thus, the operation of disengaging the first lock member 31 from the first lock recess 35 by the action of a centrifugal force is realized.

Since the first lock member 31 is disengaged from the first lock recess 35 by a centrifugal force in this manner, the control in the control unit 40 is unnecessary, and the lock release is realized even though the flow rate or the hydraulic pressure of the hydraulic oil is insufficient. Further, when the locked state of the first lock member 31 is released, the protruding portion of the second lock member 32 reaches a state where it is displaceable inside the second lock recess 36. However, since the hydraulic oil is supplied to the retarded angle chamber Cb, abrupt fluctuation is not caused even though the relative rotational phase fluctuates.

Thereafter, in a state where the rotational frequency has increased and thus the hydraulic pressure has sufficiently increased, the phase control valve 24 is controlled and the lock control valve 25 is controlled, so that the second lock member 32 is disengaged from the second lock recess 36 by the hydraulic pressure of the hydraulic oil in a state where the shear force acting on the second lock member 32 is reduced. Thus, the release of the locked state of the lock mechanism L is realized.

Therefore, it is not necessary to operate the phase control valve 24 twice in order to control two lock members. Furthermore, it becomes possible to start the lock release of the lock mechanism L without waiting for the increase of the hydraulic pressure. Thus, rapid lock release is realized.

Other Embodiments

In addition to the above-described embodiment, this disclosure may be configured as follows (parts having the same functions as those in the embodiment are denoted by the same reference numerals and symbols as in the embodiment).

(a) As a control mode of the control unit 40, for example, a control may be performed such that the lock mechanism L is in the locked state when the engine is in the idling state. After the lock mechanism L reaches the locked state in this manner, when the locked state is released, rapid lock release may be realized using the configuration disclosed here.

(b) The first release rotational frequency of the first lock member 31 is set by setting the biasing forces of the springs acting on the first lock member 31 and the second lock member 32 to be different from each other. With this configuration, it is possible to use materials having the same mass for the first lock member 31 and the second lock member 32.

(c) In the embodiment, when the second lock member 32 is disengaged from the second lock recess 36, the relative rotational phase is displaced in a direction where the shear force acting on the second lock member 32 is eliminated. Instead, however, the control mode may be set such that the hydraulic oil is supplied to the second lock recess 36 without performing a control to suppress the shear force.

In other words, after the first lock member 31 is disengaged from the first lock recess 35, the rotational frequency of the engine E increases and the hydraulic pressure of the hydraulic oil increases. Therefore, the second lock member 32 is disengaged from the second lock recess 36 by using the increasing hydraulic pressure in the control of the lock control valve 25. The lock release is realized more rapidly by performing such a control.

(d) As described with the flowchart of the embodiment, in the case where the rotational frequency reaches a set value (a value equal to or higher than the first release rotational frequency), in order to confirm that the first lock member 31 is disengaged from the first lock recess 35, the control mode may be set to acquire a signal of the phase detection sensor 8 instead of performing step #02 of the embodiment. In other words, when the first lock member 31 is disengaged from the first lock recess 35, the relative rotational phase fluctuates within a determined range by the action of the cam fluctuating torque. For this reason, when a fluctuating phenomenon of the relative rotational phase is detected by the phase detection sensor 8, it is determined as "disengaged," and a control mode is set so as to shift to the next control.

When the control mode is set in this manner, it may be properly confirmed that the first lock member 31 is disengaged from the first lock recess 35. After the confirmation, since the next control is performed, the lock release of the lock mechanism L may be securely performed.

This disclosure is applicable to a valve opening/closing timing control apparatus including a driving side rotational body and a driven side rotational body that set a valve opening/closing timing of an internal combustion engine, and a lock mechanism that locks a relative rotational phase of both rotating bodies.

An aspect of this disclosure is directed to a valve opening/closing timing control apparatus including: a driving side rotational body configured to synchronously rotate with a crankshaft of an internal combustion engine; a driven side rotational body arranged in the driving side rotational body to share a rotational axis therewith and configured to integrally rotate with a camshaft for valve opening/closing of the internal combustion engine; an advanced angle chamber and a retarded angle chamber defined between the driving side rotational body and the driven side rotational body; a lock mechanism configured to maintain a relative rotational phase between both the rotational bodies by separately biasing a first lock member and a second lock member supported by the driving side rotational body to be respectively engaged with a first recess and a second recess formed in the driven side rotational body; and a fluid controller configured to release the locked state by supplying a hydraulic fluid to the first recess and the second recess such that the first lock member and the second lock member are disengaged from the first recess and the second recess, and to control the relative rotational phase by supplying and discharging the hydraulic fluid with respect to the advanced angle chamber and the retarded angle chamber. As a rotational frequency of the driving side rotational body to bring the first and second lock members into a lock released state by a centrifugal force, a first release rotational frequency of the first lock member is set to be lower than a second release rotational frequency of the second lock member. The fluid controller controls the relative rotational phase to be a phase at which the first recess does not exert a shear force on the first lock member when lock release. The fluid controller may supply the hydraulic fluid to the second recess in a state where the rotational frequency of the driving side rotational body is higher than the first release rotational frequency at the time of lock release.

According to this configuration, when releasing the locked state of the lock mechanism, the relative rotational phase between the driving side rotational body and the driven side rotational body is controlled in a direction where the shear force acting on the first lock member is not exerted in a situation exceeding the first release rotational frequency. Thus, the action of the shear force is suppressed, and the first lock member is disengaged from the first recess by the action of a centrifugal force.

That is, in this configuration, since the hydraulic fluid is not necessarily supplied in order to release the locked state of the first lock member, it is unnecessary to operate, for example, a spool of a control valve that constitutes the fluid controller. Thus, the rapid lock release of the lock mechanism is realized.

Specifically, in this configuration, the release of the locked state is enabled even when the pressure of the hydraulic fluid is insufficient at a timing of releasing the locked state of the first lock member.

Accordingly, a valve opening/closing timing control apparatus is configured that rapidly performs release of a locked state of a lock mechanism including two lock members.

In the valve opening/closing timing control apparatus according to the aspect of this disclosure, a mass of the first lock member may be set to be larger than a mass of the second lock member.

According to this configuration, rapid release of the locked state may be realized merely by setting the difference in mass without setting the biasing forces of bias members to be different from each other.

In the valve opening/closing timing control apparatus according to the aspect of this disclosure, the first release rotational frequency may be set to be higher than a rotational frequency of the internal combustion engine during idling.

According to this configuration, the locked state of the first lock member is not released by a centrifugal force when the internal combustion engine is in an idling state. Therefore, for example, when the lock mechanism is set to be in the locked state during the warm-up of the engine due to idling or before the stop of the engine, a stable engine rotating state can be obtained without changing the relative rotational phase.

In the valve opening/closing timing control apparatus according to the aspect of this disclosure, the first release rotational frequency may be set to be higher than a rotational frequency of the internal combustion engine during idling.

In the valve opening/closing timing control apparatus according to the aspect of this disclosure, the first release rotational frequency may be set to be higher than a rotational frequency of the internal combustion engine during idling.

In the valve opening/closing timing control apparatus according to the aspect of this disclosure, a biasing force of a spring acting on the second lock member may be set to be larger than a biasing force of a spring acting on the first lock member.

In the valve opening/closing timing control apparatus according to the aspect of this disclosure, a biasing force of a spring acting on the second lock member may be set to be larger than a biasing force of a spring acting on the first lock member.

In the valve opening/closing timing control apparatus according to the aspect of this disclosure, the fluid controller may control the relative rotational phase to be a phase at which the second recess does not exert a shear force on the second lock member at the time of lock release.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening/closing timing control apparatus comprising:

a driving side rotational body configured to synchronously rotate with a crankshaft of an internal combustion engine;

a driven side rotational body arranged in the driving side rotational body to share a rotational axis therewith and configured to integrally rotate with a camshaft for valve opening/closing of the internal combustion engine;

an advanced angle chamber and a retarded angle chamber defined between the driving side rotational body and the driven side rotational body;

a lock mechanism configured to maintain a relative rotational phase between the driving side rotational body and the driven side rotational body by separately biasing a first lock member and a second lock member supported by the driving side rotational body to be respectively engaged with a first recess and a second recess that are formed in the driven side rotational body; and a fluid controller configured to release the locked state by supplying a hydraulic fluid to the first recess and the second recess such that the first lock member and the second lock member are disengaged from the first recess and the second recess, and to control the relative rotational phase by supplying and discharging of the hydraulic fluid with respect to the advanced angle chamber and the retarded angle chamber, wherein, as a rotational frequency of the driving side rotational body to bring the first and second lock members into a lock released state by a centrifugal force, a first release rotational frequency of the first lock member is set to be lower than a second release rotational frequency of the second lock member, and the fluid controller is configured to control the relative rotational phase to be a phase at which the first recess does not exert a shear force on the first lock member at a time of lock release.

2. The valve opening/closing timing control apparatus according to claim 1, wherein the fluid controller supplies the hydraulic fluid to the second recess in a state where the rotational frequency of the driving side rotational body is higher than the first release rotational frequency at the time of lock release.

3. The valve opening/closing timing control apparatus according to claim 1, wherein a mass of the first lock member is set to be larger than a mass of the second lock member.

4. The valve opening/closing timing control apparatus according to claim 1, wherein the first release rotational frequency is set to be higher than a rotational frequency of the internal combustion engine during idling.

5. The valve opening/closing timing control apparatus according to claim 2, wherein the first release rotational frequency is set to be higher than a rotational frequency of the internal combustion engine during idling.

6. The valve opening/closing timing control apparatus according to claim 3, wherein the first release rotational frequency is set to be higher than a rotational frequency of the internal combustion engine during idling.

7. The valve opening/closing timing control apparatus according to claim 1, wherein a biasing force of a spring acting on the second lock member is set to be larger than a biasing force of a spring acting on the first lock member.

8. The valve opening/closing timing control apparatus according to claim 3, wherein a biasing force of a spring acting on the second lock member is set to be larger than a biasing force of a spring acting on the first lock member.

9. The valve opening/closing timing control apparatus according to claim 1, wherein the fluid controller controls the relative rotational phase to be a phase at which the second recess does not exert a shear force on the second lock member at the time of lock release.

* * * * *